US005604949A

United States Patent [19]

Mangone

[11] Patent Number: 5,604,949

[45] Date of Patent: Feb. 25, 1997

[54] WELD-FREE GRATINGS FOR BRIDGE DECKS

[75] Inventor: Ronald W. Mangone, New Kensington, Pa.

[73] Assignee: Mangone Enterprises, New Kensington, Pa.

[21] Appl. No.: 589,500

[22] Filed: Jan. 22, 1996

Related U.S. Application Data

[63] Continuation-in-part of Ser. No. 541,732, Oct. 10, 1995.

[51] Int. Cl.[6] ..... E04C 2/42; E01D 19/12

[52] U.S. Cl. ..... 14/73; 52/668; 404/70

[58] Field of Search ..... 14/73; 52/664, 52/667, 668, 669; 404/70, 134

[56] References Cited

U.S. PATENT DOCUMENTS

| | | | |
|---|---|---|---|
| 2,114,773 | 4/1938 | Auten et al. | 14/73 |
| 2,128,753 | 8/1938 | Lienhard . | |
| 2,190,214 | 2/1940 | Nagin . | |
| 2,645,985 | 7/1953 | Beebe et al. . | |
| 2,834,267 | 5/1958 | Beebe . | |
| 3,260,023 | 7/1966 | Nagin . | |
| 4,452,025 | 6/1984 | Lew . | |
| 4,780,021 | 10/1988 | Bettigole . | |
| 4,865,486 | 9/1989 | Bettigole . | |
| 4,928,471 | 5/1990 | Bartley . | |
| 5,463,786 | 11/1995 | Mangone et al. . | |
| 5,509,243 | 4/1996 | Bettigole et al. | 52/334 |

*Primary Examiner*—James A. Lisehora
*Attorney, Agent, or Firm*—Andrew Alexander

[57] ABSTRACT

A weldless grating comprising: (a) a plurality of longitudinally extending primary load-bearing members having an upper portion, a lower portion and a web located between the upper portion and the lower portion, the primary load-bearing member having a plurality of spaced-apart openings in the web, the openings in each of the primary load-bearing members being aligned with the openings in adjacent primary load-bearing members; (b) a plurality of secondary load-bearing members having an upper edge and a lower edge, the secondary load-bearing members provided with first slots extending downwardly through the upper edge to provide top slots and with upwardly extending slots through the lower edge to provide bottom slots located substantially opposite the top slots, the secondary load-bearing members positioned in the aligned openings in the web of the primary load-bearing members, the top and bottom slots in the secondary load-bearing member forming a locking engagement with the web surrounding the openings in the primary load-bearing members, the secondary load-bearing members provided with secondary downwardly extending slots through the upper edge, secondary downwardly extending slots located between primary load-bearing members; (c) a plurality of tertiary load-bearing members positioned in the secondary slots in the secondary load-bearing members; and (d) a rod extending through the tertiary load-bearing members and the primary load-bearing members.

29 Claims, 8 Drawing Sheets

WELD-FREE GRATINGS FOR BRIDGE DECKS

CROSS REFERENCE TO RELATED APPLICATIONS

This application is a continuation-in-part of U.S. Ser. No. 08/541,732, filed Oct. 10, 1995.

BACKGROUND OF THE INVENTION

This invention relates to grids or gratings useful for open or filled bridge decks, walkways, drain gratings and the like and more particularly, this invention relates to grids or gratings that are constructed and held together without welding.

In making prior gratings for bridge decks, whether the deck is open or filled with concrete, a certain amount of welding is performed to hold or bind the individual components together. That is, if the grid is used for open grating or open bridge deck, the main load-bearing members, secondary load-bearing members and tertiary load-bearing members are welded together, usually by puddle welding, to hold the members together and give the deck or grating strength. Even if the grid or deck is to be encased in concrete, still some welding is required to hold the assembly in a rigid configuration until the concrete hardens. If only minimal welding is performed, then the deck or grid work when encased in concrete has a decreased level of strength. Thus, for peak bridge strength, the various components of the grating or bridge deck must be fastened together to perform as a unit.

Various deck or grating systems have been proposed in the art, and the members comprising the grating deck are welded together. For example, U.S. Pat. No. 3,260,023 discloses a bridge floor and surfacing component. The bridge floor comprises parallel bearer bars and cross bars. The cross bars are pressure welded into the tops of the bearer bars.

U.S. Pat. No. 4,865,486 discloses a method of assembling a steel grid and concrete deck wherein the primary load bearing bars are formed with openings to receive slotted secondary load bearing bars that are passed through the primary load bearing bars. However, the patent discloses that tack welds are used to temporarily hold the grating in its desired configuration. A concrete component encases at least the top surface of the grating base member and secures the elements of the grating base member together.

U.S. Pat. No. 2,128,753 discloses a steel floor construction having a series of parallel main bars in spaced relationship. Each of the main bars is provided with a plurality of rectangular-shaped openings. The openings are designed to permit the insertion thereon and the positioning of two cross bars. A third set of bar is placed in slots in the cross bars. After the members are assembled, the entire construction may be welded together to maintain the different parts in position.

U.S. Pat. No. 2,190,214 discloses a grating wherein a desired number of parallel spaced apart main bearer bars with intermediate bearer bars of less depth are placed between the main bearer bars. The main bearer bars and intermediate bearer bars are connected at their tops by cross bars secured thereto by electric pressure welding. Carrier bars which pass through slots in the main bearer bars are welded to the intermediate bearer bars. Also, carrier bars are welded to the main bearer bars.

U.S. Pat. No. 2,645,985 discloses an open floor grating having a plurality of longitudinal primary members, a plurality of transverse secondary members welded to and extending between the primary members. A plurality of tertiary members are welded to the secondary members. A rod is inserted through holes in the webs of the primary members and welded thereto.

U.S. Pat. No. 2,834,267 discloses a grating comprised of a plurality of spaced parallel main longitudinal bars and a plurality of spaced parallel lacing bars and tertiary longitudinal bars intermediate the main bars. Bottom bars are inserted through holes in the webbing of the main bars. The intersection between the lacing bars and the tertiary bars are welded and the bottom bar is welded to the webbing of the main bar.

U.S. Pat. No. 4,452,025 discloses a self-interlocking grille consisting of a plurality of metallic or plastic strips or flats or bars with certain types of notches and holes disposed along the length of the strip or flats or bars in a regular interval, which are used together with a plurality of rods in assembling a variety of interlocking grills.

U.S. Pat. No. 4,780,021 discloses an exodermic deck conversion method for converting a conventional grid deck to an exodermic deck. Tertiary load bearing bars are placed on top of the grating parallel to and between the primary load bearing bars. A plurality of shear connectors, such as vertical studs, are welded or attached to the surface of the grating. It will be seen from the above that in gratings and bridge decks, usually some form of welding or cement is used to hold the assembly together.

However, welding gratings or deck structures have the problem that toxic fumes are released into the atmosphere causing health hazards to the welders and pollution of the environment. Welding of structures such as bridge decks results in curling or deforming of the deck as the welds cool. Thus, the design of the deck is complicated in that the curling or deforming must be accommodated in the design. Further, welding has the disadvantage that it is time consuming and often is the rate-determining step at which decks can be built. Welding also requires that the gratings or deck assemblies be maintained in jigs prior to starting the welding process. This is an additional, undesirable step in the process of making a bridge deck. Further, welds on bridge decks have the problem of cracking either with use or as the temperature cycles between winter and summer. It is desirable to rustproof gratings by galvanizing. However, because galvanizing is destroyed by welding, the welded grating or deck is often galvanized as a unit. However, this also results in temperature cyclization and warping of the bridge deck with the result that welds often break, detrimentally affecting the integrity of the deck.

Thus, it will be seen that there is a great need for an improved bridge deck or grating which will eliminate these problems and will provide for an improved deck or grating structure. The present invention provides such a structure.

SUMMARY OF THE INVENTION

It is an object of the present invention to provide an improved grating.

It is another object of the invention to provide a grating suitable for use on bridge decks.

It is a further object of the invention to provide an interlocking grating fastened together without need for welding.

Still, it is another object of the invention to provide an interlocking grating which may be used for open bridge decks or may be utilized with a concrete component that encases at least a top portion of the grating.

Yet, it is a further object of the invention to provide an interlocking grating for bridge decks and the like employing a primary load-beating member and a secondary load-bearing member securely held together without welding.

And yet, it is an additional object of the invention to provide an interlocking grating for open or concrete encased bridge decks and the like employing a primary load-bearing member, a secondary member and a tertiary load-bearing member held together without welding.

These and other objects will become apparent from the drawings, specification and claims appended hereto.

In accordance with these objects, there is provided a grating comprising: (a) a plurality of longitudinally extending primary load-bearing members having a top portion, a bottom portion and a web located between the top portion and the bottom portion, the primary load-bearing member having a plurality of spaced-apart openings in the web, the openings in each of the primary load-bearing members being aligned with the openings in adjacent primary load-bearing members, the openings in the web having a generally cross shaped configuration having a vertical extent having a top and bottom and a horizontal extend having a first side and a second side, the distance between the top and bottom of the vertical extent being shorter than the distance between the first side and the second side of the horizontal extent, the opening having a first land and a second land substantially opposite to each other, the first land extending from the top of said vertical extent to said second side, the second land extending from said first side to said bottom, said lands providing a bearing surface for a secondary load-bearing member; (b) a plurality of secondary load-bearing members having a top edge and a bottom edge, the secondary load-bearing members provided with first slots extending downwardly through the top edge to provide top slots and with upwardly extending slots through the bottom edge to provide bottom slots located substantially opposite the top slots, the secondary load-bearing members positioned in the aligned openings in the web of the primary load-bearing members, the top and bottom slots in the secondary load-bearing member forming a locking engagement with the web surrounding the openings in the primary load-bearing members, the secondary load-bearing members provided with secondary downwardly extending slots through the top edge, secondary downwardly extending slots located between primary load-bearing members; (c) a plurality of tertiary load-bearing members positioned in the secondary slots in the secondary load-bearing members; and (d) a rod extending through the tertiary load-bearing members and the primary load-bearing members locking the tertiary load-bearing members in the slots in the secondary load-bearing members and locking the secondary load-bearing members in the openings in the primary load-bearing members to form the weldless grating.

DETAILED DESCRIPTION OF PREFERRED EMBODIMENTS

Figure 1:
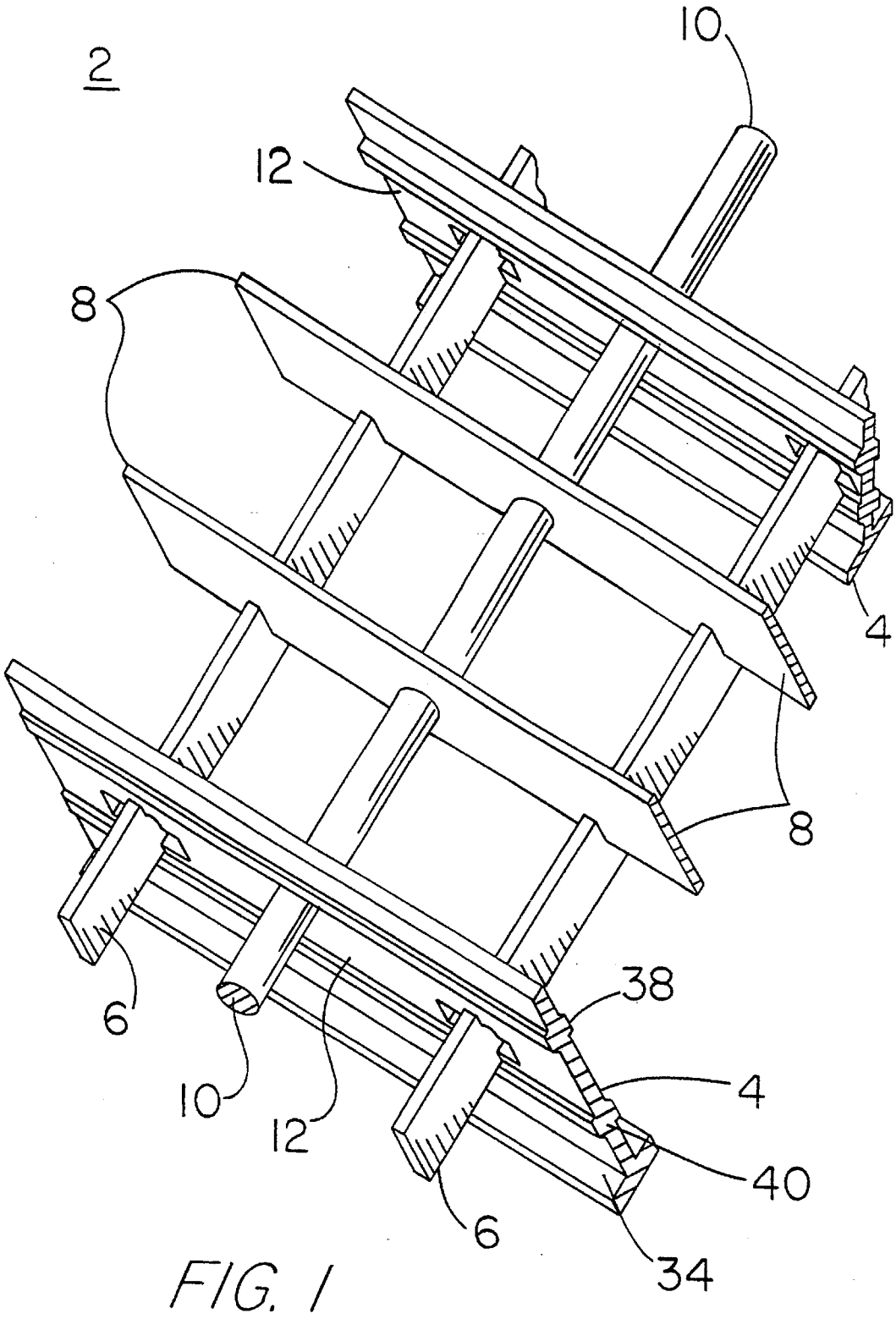
FIG. 1 is a perspective view of a grating in accordance with the invention showing a secondary load-bearing member locked in the web of a primary load-bearing member.

Referring now to FIG. 1, there is shown a grating in accordance with the present invention. Grating or grid 2 is comprised of a plurality of primary load bearing bars 4, a plurality of transverse secondary bars 6, a plurality of tertiary bars 8 shown running substantially parallel to the primary load bearing bars 4. A rod 10 is shown laced through web 12 of primary load bearing bar 4 and through tertiary bars 8.

Figure 2:
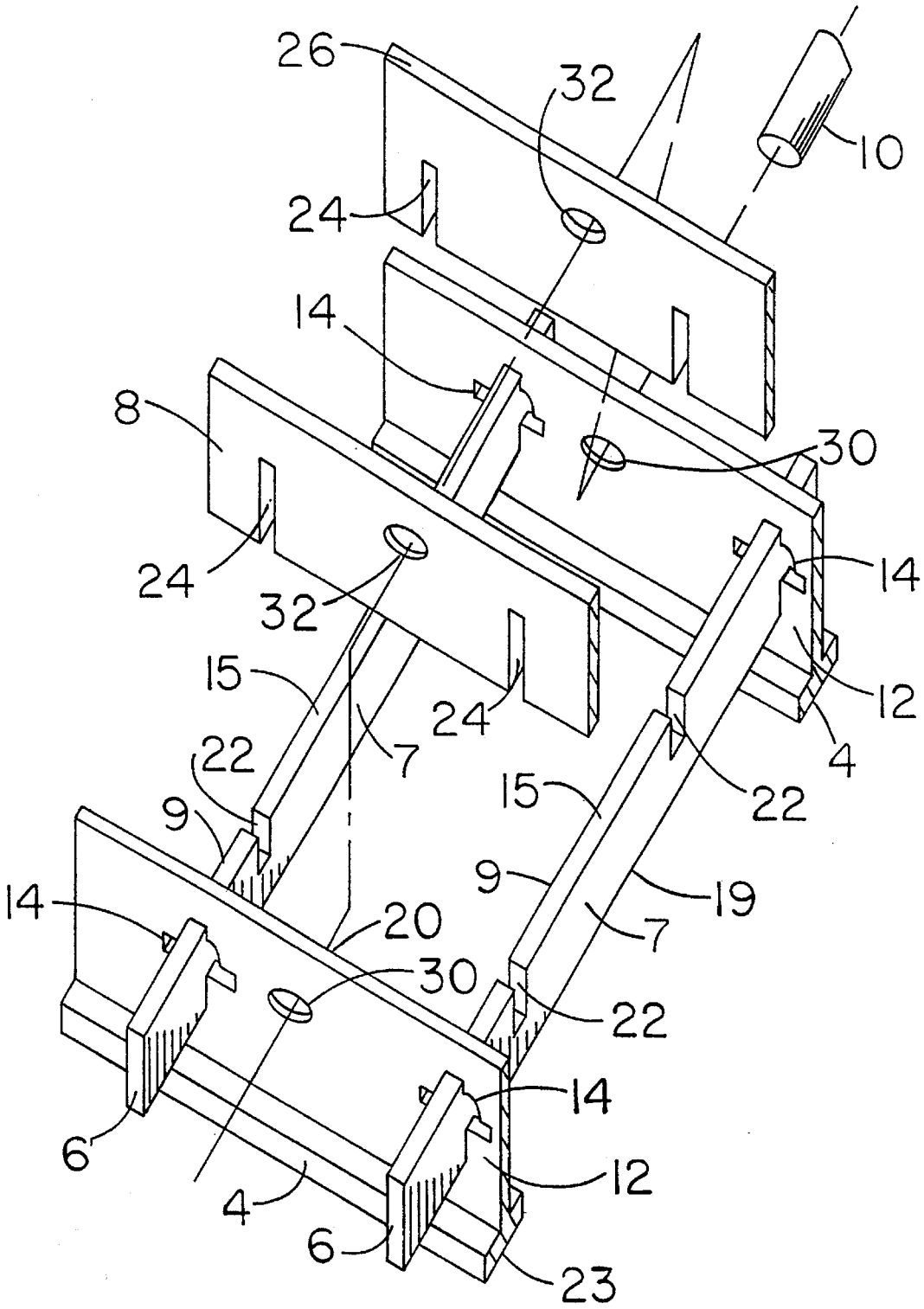
FIG. 2 is a perspective view showing the parts of the grating of FIG. 1 in unassembled relationship.
Figure 7:
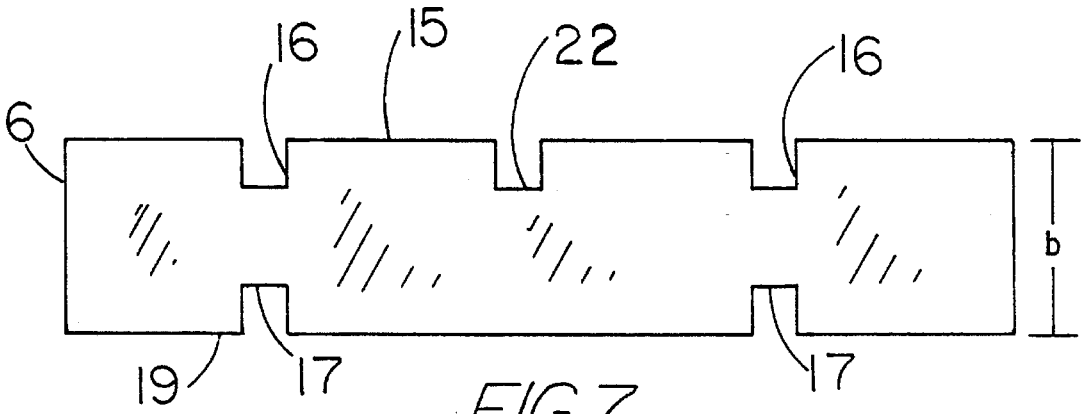
FIG. 7 is a side view of the secondary load-bearing member in FIG. 6.
Figure 8:
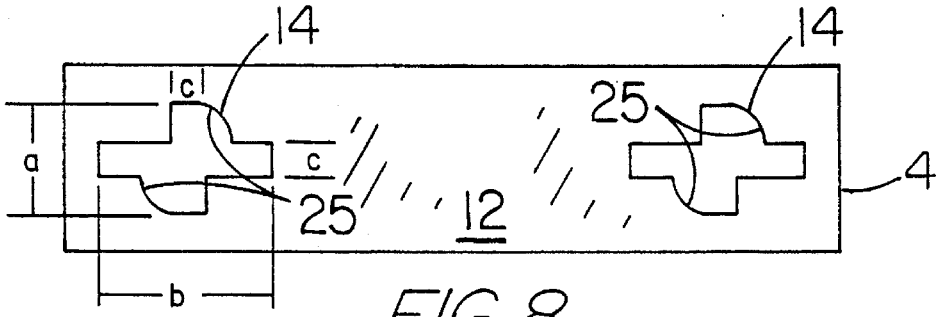
FIG. 8 is a side view of the primary load-bearing member with openings in the web for receiving primary load-bearing members.

In FIG. 2, the primary load bearing bars 4 and transverse or secondary load bearing bars 6 are shown in partial unassembled relationship along with tertiary bars or tertiary load-bearing members 8 and rod 10. It will be seen that primary load bearing bars 4 have openings 14 (see FIG. 8) cut out to receive secondary bar 6. Openings 14 can have different configurations, one of which is shown in FIG. 8. Thus, each primary load bearing bar 4 has a plurality of openings 14 to receive each secondary load bearing bar 6. Further, each secondary load bearing bar 6 has a plurality of slots 16 and 17 (see FIG. 7) that align with openings 14 in primary load bearing bar 4 when assembled.

With respect to secondary load-bearing members 6, these are shown having a generally rectangular cross-sectional configuration for convenience. However, other cross-sectional shapes may be utilized. Secondary load-bearing members 6 are shown in FIG. 7 in a preferred embodiment having three slots 16 and 22 on top surface 15 and two slots 17 on bottom surface 19. Slots 16 and 17 are positioned opposite each other so as to engage web 12 of primary load-bearing member 4 when secondary load-bearing member 6 is turned to a vertical position, as explained later. Further, secondary load-bearing member 6 is provided with a slot 22 to engage tertiary load-bearing member 8 when the grating is assembled. Slots 16, 17 and 22 are formed to provide a snug fit when engaged or locked with web 12 and tertiary load-bearing member 8. Further, these slots may be tapered from edge, e.g. 15, to the bottom of the slot to provide for improved engagement and minimize play between the mating members. In certain applications, slots 22 may be eliminated provided a sufficiently deep slot is provided in the bottom side of the corresponding tertiary load-bearing member 8.

Figure 6:
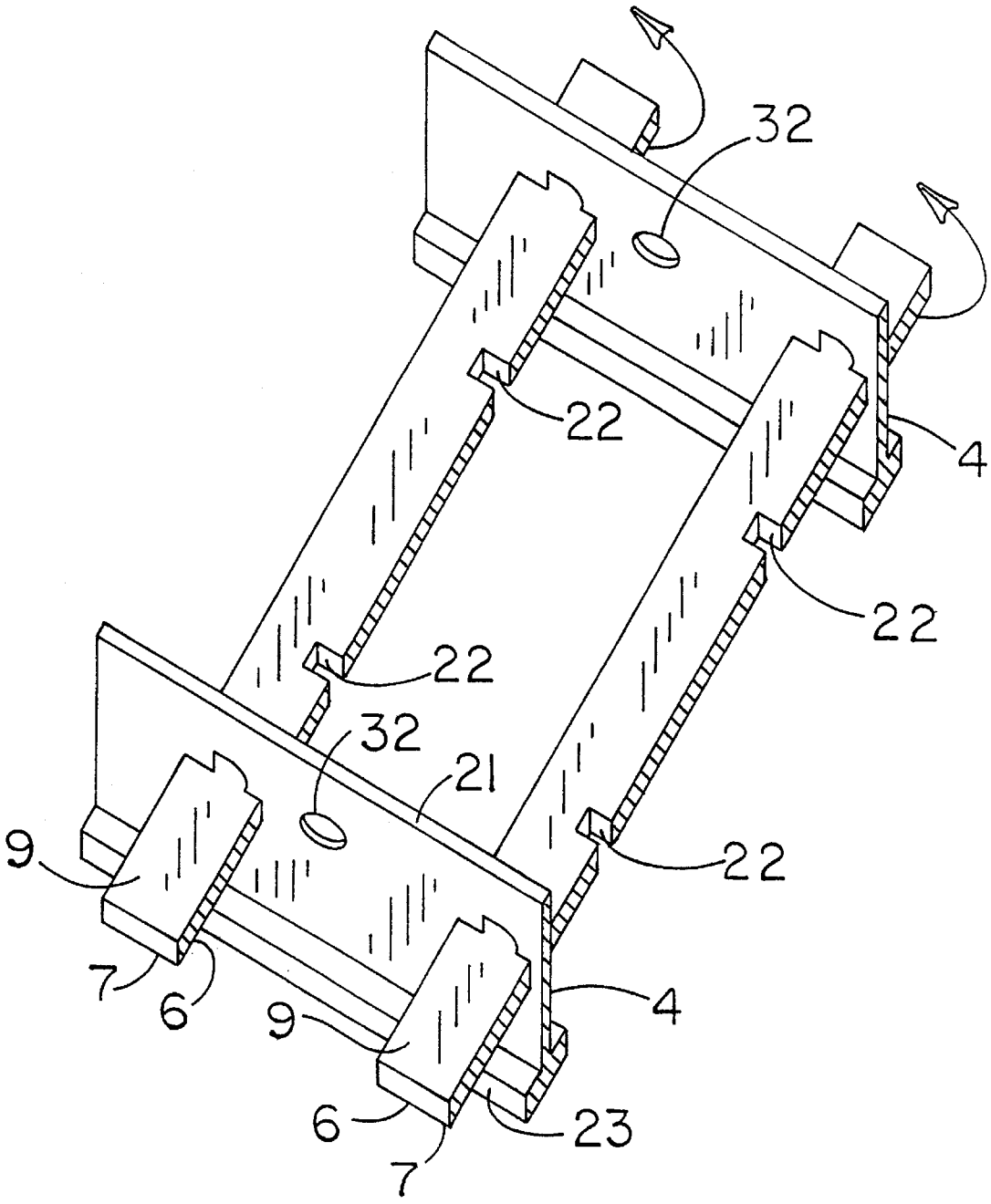
FIG. 6 is a perspective view illustrating partial locking of secondary load-bearing members into primary load-bearing members.

Primary load-bearing member 4 is generally rectangular in cross-section and may have ribs or flanges projecting from either or both sides. FIG. 8 shows a side view of a primary load-bearing member 4 showing openings 14 formed in web 12. Two openings are shown for illustration purposes. For purposes of locking secondary load-bearing member in primary load-bearing member 4, secondary load-bearing member 6 is inserted on its side into primary load-bearing member 4 as illustrated in FIG. 6. Thus, extent b of opening 14 must be at least slightly larger than height d of secondary load-bearing member 6. Also, extent c of opening 14 must be just slightly larger than the thickness of secondary load-bearing member 6. When opening 14 has these dimensions, then secondary load-bearing member 6 can be inserted on its side through opening 14 until alignment with slots 16 and 17 are reached, as shown in FIG. 6.

In opening 14, the extent or dimension represented by "a" is smaller than the dimension represented by "b" in order that secondary load-bearing member locks in web 12. Further, the "a" dimension is preferably slightly larger than the "d" dimension in secondary load-bearing member 6 which extends from the bottom of slot 16 to the bottom slot 17. However, the closer the tolerance maintained between these two dimensions, the more rigidity is maintained in the grating. It will be appreciated that there is a balance in the tolerances of all the slots and thickness of material inserted therein and ease of assembly of the grating. That is, the tighter the tolerances maintained, the more rigid the grating. It should be noted that openings 14 are provided with a ramp or land 25 by removal of web material to permit secondary load-bearing member 6 to be turned and locked in web 12.

For purposes of illustrating the assembly of weldless grating 2 in accordance with the invention, in one embodiment, secondary load-bearing members 6 are laced through openings 14 in primary load-bearing members 4. In the method of lacing secondary load-bearing members 6 through primary load-bearing members 4, secondary load-bearing member 6 is turned on its side. That is, as shown in FIG. 6, side 7 of secondary load-bearing member 6 is located underneath and side 9 is located on the top. After secondary load-bearing member 6 is inserted through openings 14 to the extent where slots 16 and 17 (FIG. 7) coincide or align with web 12, secondary load-bearing member 6 is rotated counter clockwise (FIG. 6) where sides 7 and 9 are in a substantially vertical position. In this position, web 12 is engaged by or inserted into slot 16 on top edge 15 of secondary load-bearing member 6. Also, concurrently therewith, web 12 is engaged by or inserted into slot 17 (FIG. 7) on bottom edge 19 of FIG. 7. Thus, web 12 is engaged by or locked into slot 16 on the top of edge 15 of secondary load-bearing member 6 and also engaged by or locked into slot 17 on bottom edge 19 of secondary load-bearing member 6. While secondary load-bearing member 6 is maintained in an upright position as shown in FIGS. 1 or 2, then the top 20 and bottom 23 of primary load-bearing member 4 is prevented from moving in the direction of adjacent primary load-bearing member 4. In this embodiment of the invention, secondary load-bearing member 6 is maintained in a substantially vertical position by use of tertiary load-bearing member 8 (FIGS. 1 and 2).

It should be noted that different shapes may be used for opening 14 and different methods of assembly may be used. For example, secondary load bearing bar 6 may be turned clockwise instead of counterclockwise. Further different methods of interlocking may be employed. All of these are contemplated within the purview of the invention.

Figure 11:
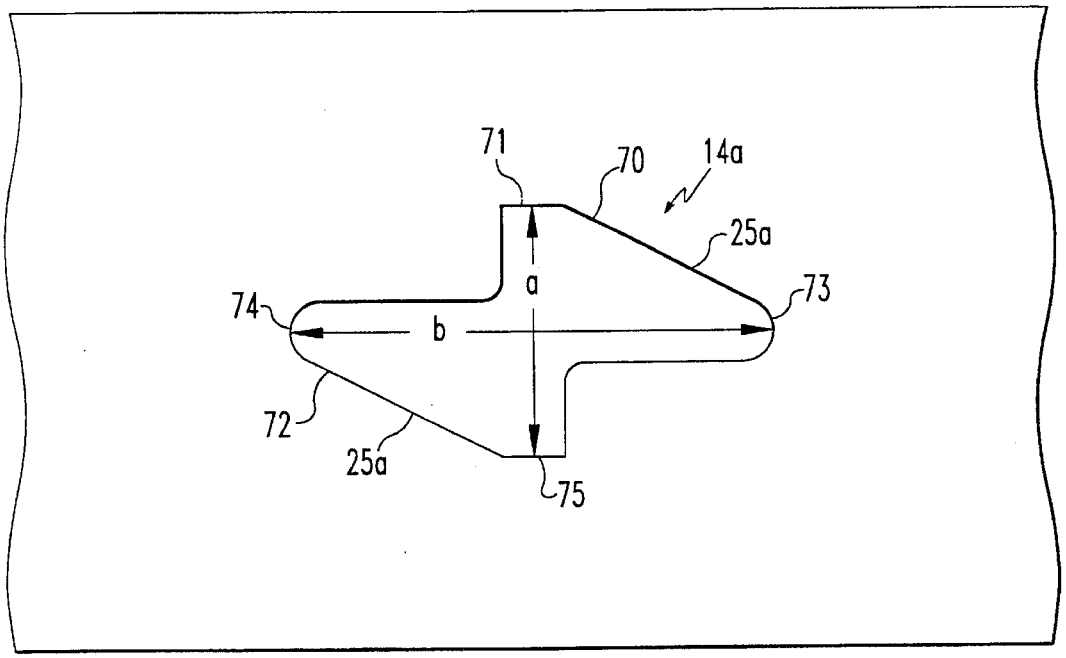
FIG. 11 is a perspective view of a preferred shape of an opening for interlocking two load-bearing members.

A preferred opening **14*a* is shown in FIG. 11. It will be seen that opening 14*a* has a generally cross-shaped configuration as represented by the dimension or extent "a" and "b". It should be noted that the dimension represented by "b" is greater than the dimension represented by "a". Opening 14*a*** is shown with the longer dimension on the horizontal and the shorter dimension in the vertical. However, these dimensions can be oriented in any direction as long as one dimension is longer than the other. Thus, the use of horizontal and vertical as used herein is meant to include any of these different orientations.

Figure 12:
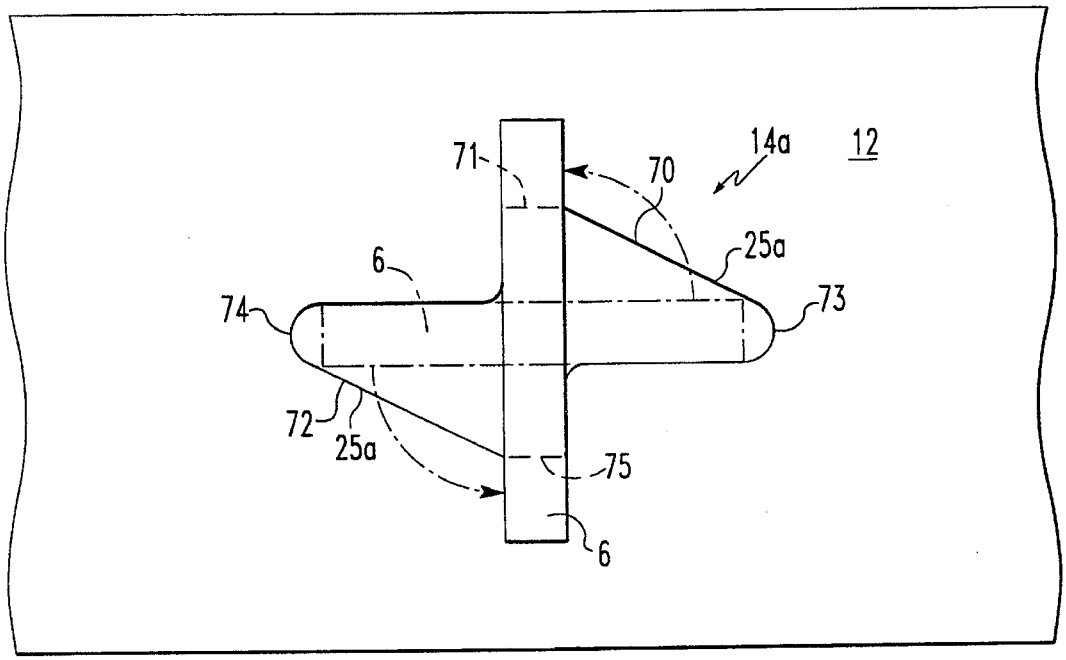
FIG. 12 is a view illustrating two load-bearing members interlocked in accordance with the invention.

In preferred opening **14*a* (FIG. 11 ), a ramp or land 25*a* is provided. In FIG. 11, ramp or land 25*a* is generally defined by straight lines 70 and 72. Straight line 70 extends from top 71 of vertical extent represented by "a" to side 73 of the extent represented by "b". Further, ramp or land 72 is defined by a line extending from side 74 of horizontal extent represented by "b" to bottom 75 of vertical extent represented by "a". Land 70 and 72 are substantially opposite each other. In the present invention, opening 14*a* as defined is very important. That is, land 72 sloping downwardly from horizontal extent "b" and land 70 sloping upwardly from horizontal extent "b" are important in that both ramps facilitate locking of a second load-bearing member in a first or primary load-bearing member and provide for ease of assembly of the weldless grating by ramping or guiding the secondary load-bearing member into position and maintaining the secondary load-bearing member in position until the weldless grating is locked together. This is illustrated in FIG. 12 where secondary load-bearing member 6 is shown in the upright position. Secondary load-bearing member 6 is shown in dotted line or outline form in the horizontal position in FIG. 12 and then in solid line form after being rotated to the upright position. In the upright position, secondary load-bearing member 6 extends above top 71 and below bottom 75 to lock secondary load-bearing member 6 in web 12**.

It should be noted that two slots opposite each other have been provided in secondary load-bearing member 6. However, it will be appreciated that bottom slot 17 (FIG. 7) may be eliminated and slot 16 used to provide sufficient engagement with web 12, or top 16 may be eliminated in which case bottom slot 17 is retained to provide locking engagement with web 12.

Opening **14*a* is advantageous in that as secondary load-bearing member 6 is moved from the horizontal to the upright position, ramp or land 72 aids in preventing secondary load-bearing member 6 from sliding backwards and defeating the turning of secondary load-bearing member 6 to the upright position. It should be understood that if land 72 were flat or horizontal instead of sloping downwardly, then turning secondary load-bearing member 6** to the upright position is more difficult.

In addition, because the grating of the subject invention does not require welds and may be assembled on site, for example, at a bridge site to minimize shipping costs, it is important that it be capable of assembly without a jig as is normally required for welded decks or grating. Thus, it is important that the members comprising deck or grating remain in place until locking is accomplished. Thus, for example, to facilitate assembly, it is important that secondary load-bearing member 6 remain in the upright position in opening 14*a* until additional secondary load-bearing members 6 are positioned in the upright position and until they are locked in position. Land or ramp 72 aids in maintaining secondary load-bearing member 6 in the upright position by not permitting the bottom secondary load-bearing member 6 to slide away from the upright position.

Figure 13:
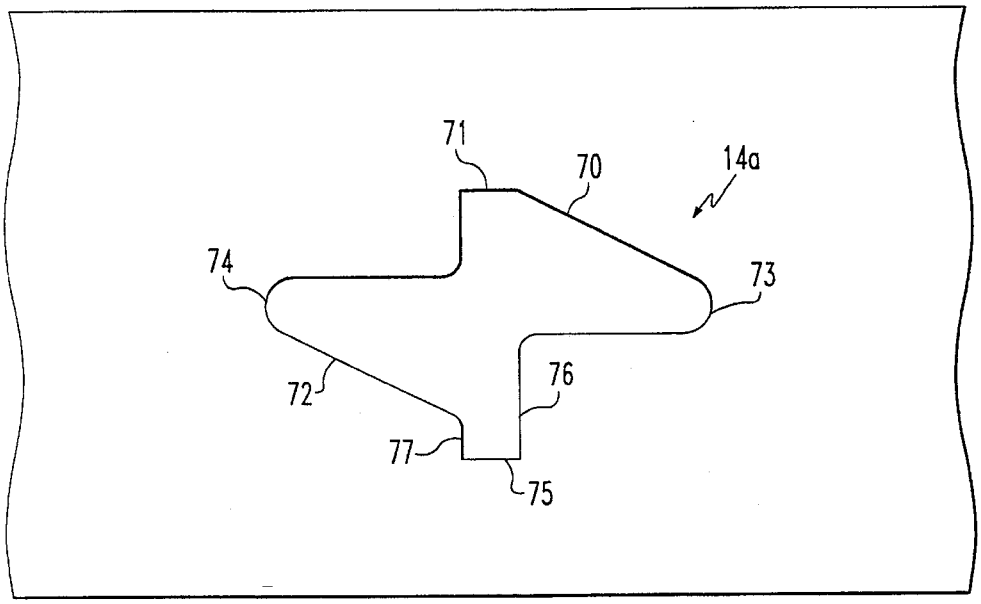
FIG. 13 is a perspective view of a modified opening for interlocking two load-bearing members.

If the need arises for secondary load-bearing member 6 to be more rigidly fixed in the upright position, bottom 75 (FIG. 13) can be recessed below the line or surface 72 to permit secondary load-bearing member 6 to be anchored. Thus, wall 76 and wall 77 ensure against secondary load-bearing member 6 moving to either side and thus fewer personnel are required for assembly.

Figure 14:
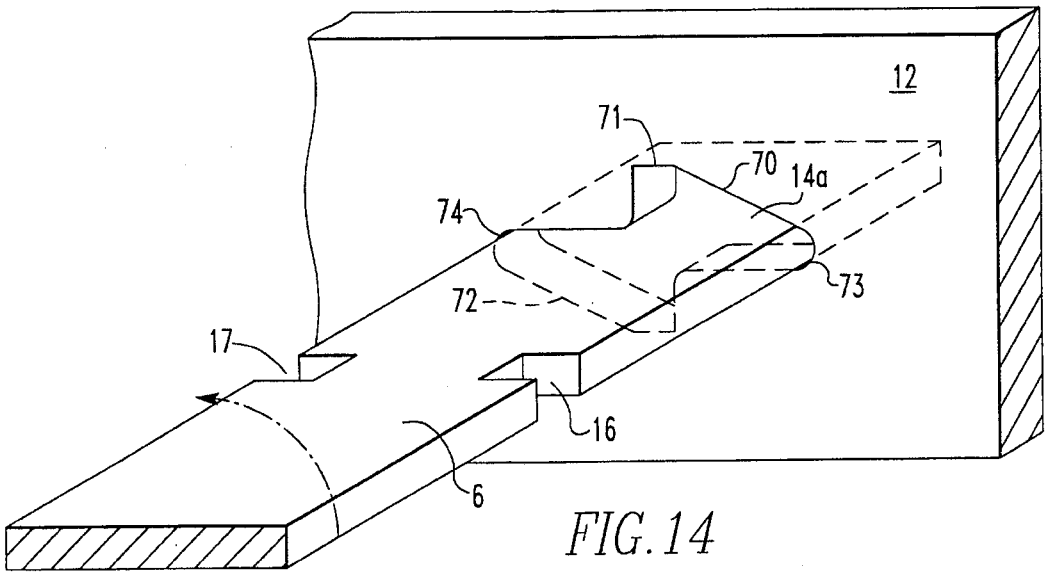
FIG. 14 is a schematic showing a first load-bearing member having a preferred opening and a second load-bearing member being inserted into the opening, the second member suited for locking in the first member.

FIG. 14 shows in greater detail the fitting or assembly technique required when sliding secondary load-bearing member 6 into opening 14*a* in web 12 of primary load-bearing member 4. As shown in FIG. 6, secondary load-bearing member 6 is positioned first in a horizontal plane for insertion into opening 14*a*. This is the preferred method. However, opening 14*a* may be formed so that extend "b" is not horizontal but formed at an angle to the horizontal plane. Vertical extent "a" is preferred to remain in the upright position in order to obtain the highest strength level from secondary load-bearing member 6, particularly when secondary load-bearing member 6 has a rectangular configuration. If secondary load-bearing member 6 was X-shaped, then extent "a" could be angled from the vertical to accommodate each leg of the "X" configuration. Secondary load-bearing member 6 is inserted to the point where all slots 16 and 17 are aligned with webs 12. When secondary load-bearing member 6 is rotated upwardly, slot 16 engages web material above ramp 70 and likewise slot 17 engages web material below ramp 72.

Figure 15:
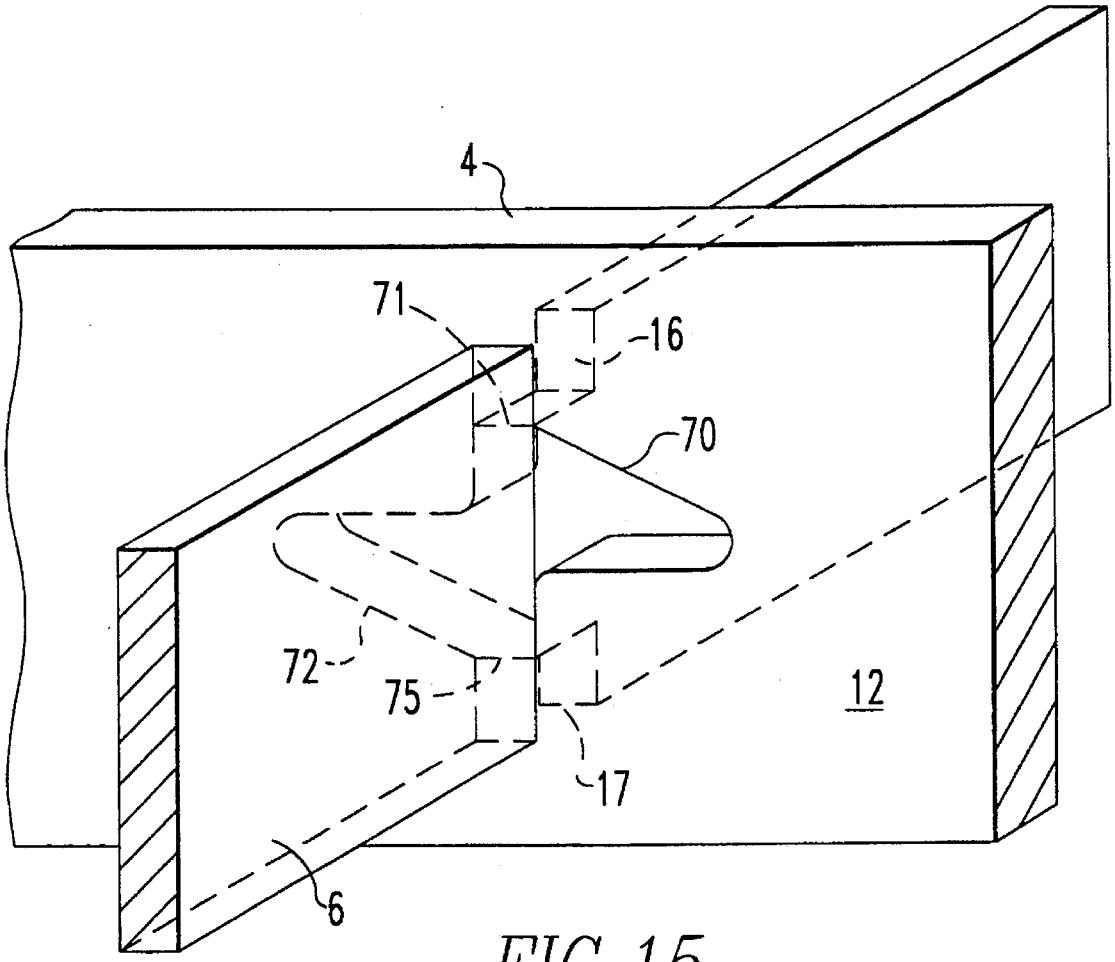
FIG. 15 is a schematic representation showing second load-bearing member locking in the first load-bearing member utilizing the preferred opening and locking mechanism of the invention for ease of assembly.

In FIG. 15, secondary load-bearing member 6 is shown in the upright position locked in web 12 of primary load-bearing member 4 by slots 16 and 17. When slots 16 and 17 are formed to provide a snug fit over web 12, then primary load-bearing member 4 remains fixed in position and substantially parallel to the adjacent primary load-bearing members.

Tertiary load bearing bars 8 are provided with a plurality of slots 24 for alignment with slots 22 (FIG. 2). In one embodiment of the assembly, slots 24 line up with slots 22 so as to provide a planar surface, if necessary. To provide a planar surface, slots 24 and 22 should have a depth equal to half the depth of tertiary load bearing bar 8. However, as explained earlier, if it is desired to have tertiary load bearing bar 8 project above edge 20, then slot 22 may be shallower. Also, as explained earlier, any combination of slot depths may be used to provide either a planar surface or a ridge or rough surface for traction. Similarly, slots 22 may be eliminated if slots 24 are sufficiently deep in member 8. For certain applications, slots 24 may be eliminated, for example, when slots 22 are sufficiently deep to accommodate tertiary load-bearing member 8.

Thus, it will be seen that in assembly, primary load bearing bars 4 are first placed or fixed in position and then secondary load bearing bars 6 are placed on their side and laced through openings 14 of primary load bearing bars 4. When slots 16 and 17 are in alignment with web 12, secondary load-bearing member 6 is turned counter clockwise to a vertical position to ensure that slots 16 and 17 engage web 12 to lock it in position and prevent lateral movement. It should be noted that if either slots 16 or 17 are missing, then the grating loses rigidity. Thereafter, tertiary load bearing bars 8 are placed across secondary load bearing bars 6 with slots 22 and 24 being aligned for engagement.

For purposes of locking the assembly comprised of primary load bearing bar 4, secondary load bearing bars 6 and tertiary load bearing bars 8, an aperture 30 is provided in primary load bearing bars 4 between secondary load bearing bars 6, the aperture being formed to have an axis substantially parallel to secondary load bearing bars 6. Likewise, tertiary load bearing bars 8 have apertures 32 formed so as to be in alignment with apertures 30 of primary load bearing bars 4. Rod 10 then is fitted through a first aperture 30 in a first primary load bearing bar 4, then through apertures 32 of tertiary load bearing bar 8 and finally through a second aperture 30 in second primary load bearing bar 4. In this assembly, end 5 of rod 10 may be bent, fitted with a pin or nut to ensure that it does not move. Thus, after having secured rod 10, primary load bearing bars 4, secondary load bearing bars 6 and tertiary load bearing bars 8 are locked together to form a unit grating, grid work, fence or railings without the attendant problems inherent with welding. Further, because of the additional rod used, the strength of the grating structure is improved dramatically. It will be appreciated that one rod or more can be used between each set of secondary load bearing bars 6. Further, fewer rods can be used. That is, in the present invention rods 10 can be selectively placed between secondary load bearing bars 6. For example, in the present invention, high strength grating can be obtained when rods 10 are used between every other set of secondary load bearing bars 6.

With respect to rod 10, it will be noted that a round bar has been illustrated. However, any cross-sectional configuration may be used.

In FIG. 1, primary load bearing bar 4 is shown with a lower flange 34, a web portion 12, a bulbous portion 38, and a rib 40. However, primary load bearing bars 4 can have other cross-sectional configurations that may be used. In the embodiment shown in FIG. 1, rib 40 and flange 34 provide for special features as explained herein.

Secondary load bearing bars 6 can have a depth generally less than the depth of primary load bearing bars 4, and tertiary load bearing bars 8 can have a depth less than the depth of secondary load bearing bars 6. Further, it should be noted that if tertiary load bearing bars 8 are sufficiently deep, then notch or slots 24 may be of sufficient depth to accommodate the full depth of the secondary load bearing bars 6 without slots 22 being provided in secondary load bearing bars 6. Rod 10 can provide sufficient resistance to sideways movement of tertiary load bearing bars 8.

Figure 3:
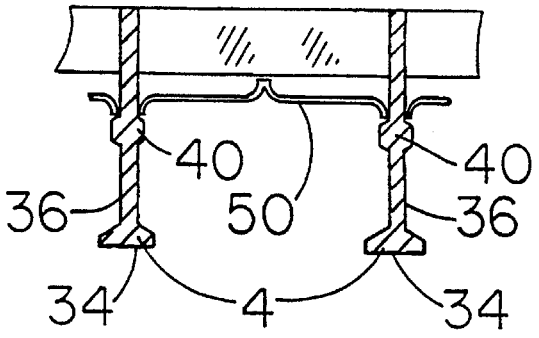
FIG. 3 is an end view along the primary load-bearing members showing a pan mounted on upper ribs of the primary load-bearing members to contain wet concrete.
Figure 9:
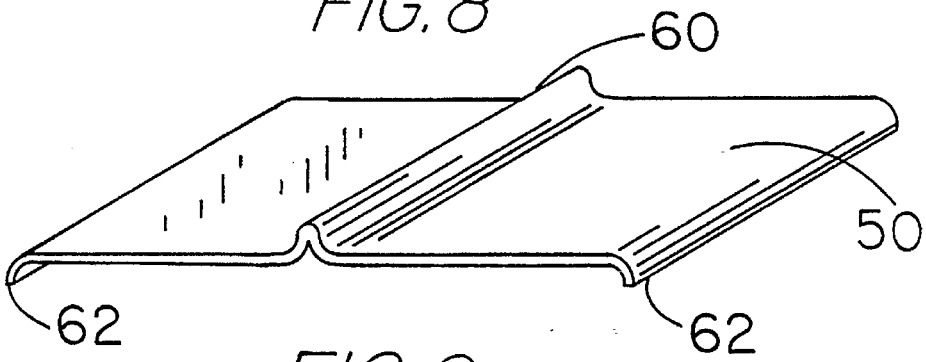
FIG. 9 is a perspective view of the pan of FIG. 3.
Figure 10:
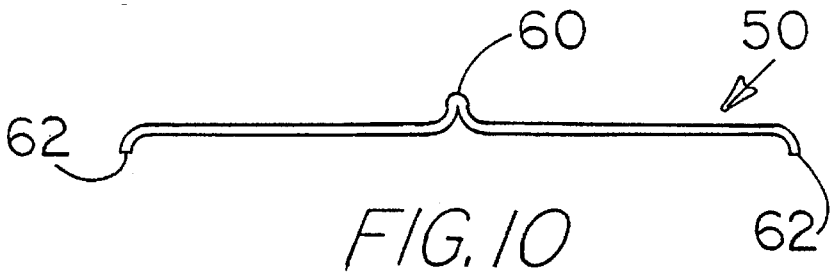
FIG. 10 is an end view of the pan of FIG. 3.

When it is desired to encase at least a portion of the grating in concrete, a pan or sheet member 50 is positioned between primary load bearing bars 4 as shown in FIG. 3. Pan 50 is formed to extend the length of primary load bearing bars 4 and to rest on ribs 40. Thus, pan 50 is preferably shaped substantially as shown in FIGS. 9 and 10. That is, pan 50 is provided with a rib 60 which extends the length of the pan in a direction generally parallel to primary load-bearing member 4. Further, preferably pan 50 is generally curved or shaped concave upwardly towards rib 60 as shown in FIGS. 9 and 10. Rib 60 provides for stiffness in the pan. In addition, from edge 62 to the top of ridge 60 should be controlled. That is, in the preferred embodiment, when concrete is to be used as a wear surface or to partially encapsulate grating 2, pan 50 is positioned between primary load-bearing member 4 prior to secondary load-bearing member 6 being turned to an upright position. Edges 62 of pan 50 rest on the upper surface of rib 40, as shown in FIG. 3, for example. When secondary load-bearing member 6 is turned into locking position, bottom or lower side 19 of secondary load-bearing member 6 contacts ridge 60 sufficiently to secure pan 50 in place by friction. Thus, the grating can be shipped to the job site without pans 50 moving or dropping out of the grating. It should be noted that welding pans 50 in place is undesirable because of warpage that occurs. The warpage results in uneven thickness of concrete and also in spaces between the rib and the pan which results in wet concrete seeping or dripping onto the surfaces below. The assembled grating in accordance with the invention has a rigid configuration without substantially any movement of the bars or members. Thus, for example, because primary load bearing bars do not move or wobble, the pans can be placed on or inserted between the primary load bearing bars prior to shipping.

Figure 4:
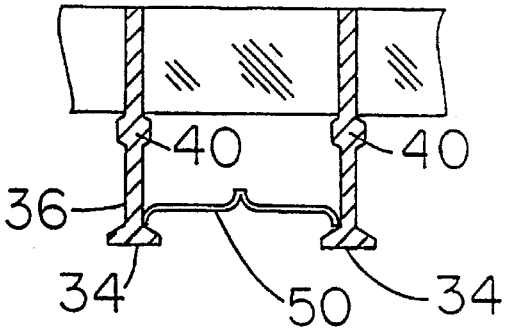
FIG. 4 is an end view along the primary load-bearing members showing a pan mounted on lower ribs of the primary load-bearing members to contain wet concrete.

If it is desired to encase substantially the depth of the grating in concrete, pan 50 can be located, as shown in FIG. 4.

Figure 5:
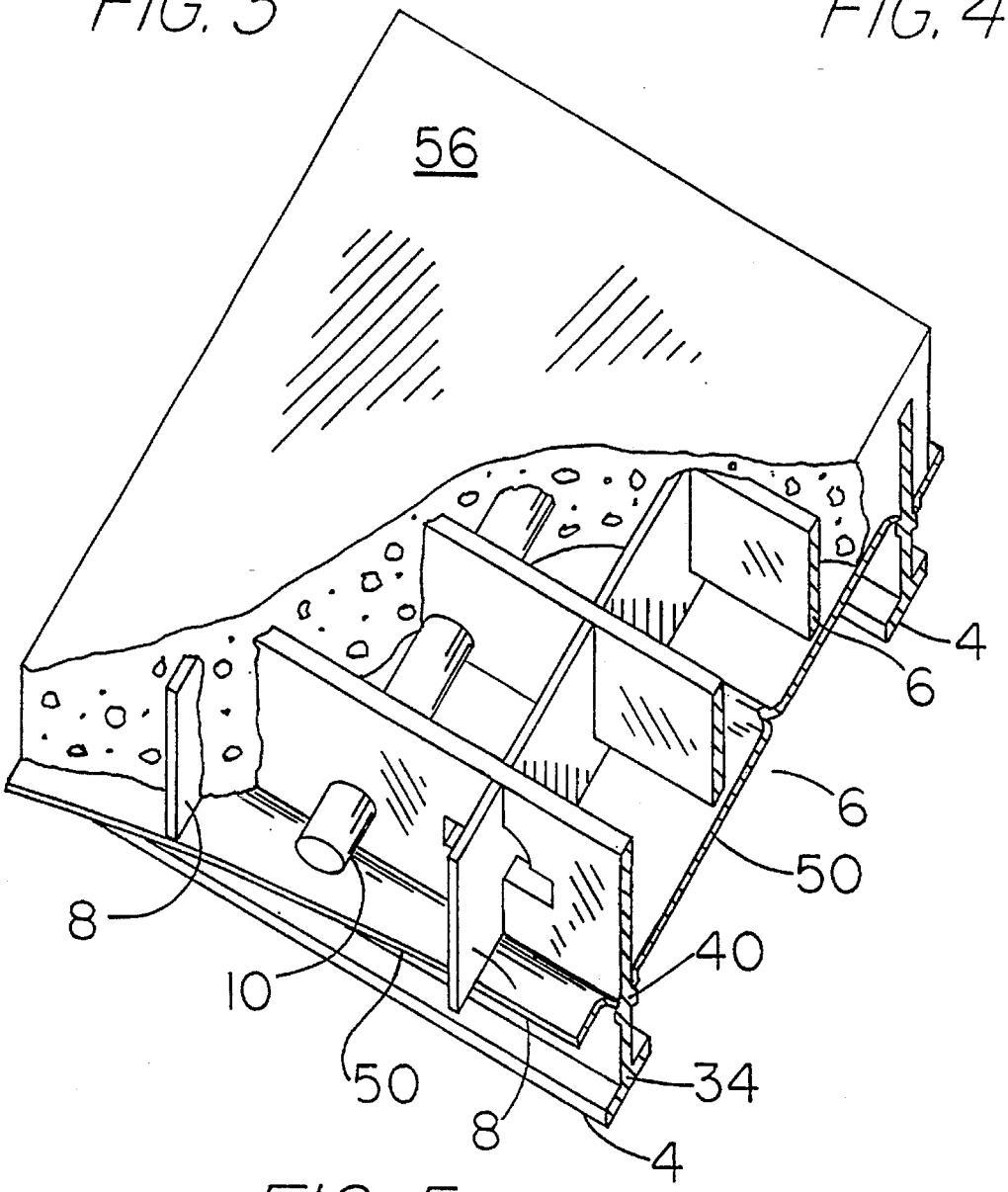
FIG. 5 is a perspective cutaway view of a grating utilizing a deep web with concrete encasing the top portion of the grating.

FIG. 5 is a schematic showing concrete 56 provided in the upper portion of the grating.

It should be understood that while the grating of the invention has been shown encasing a top portion of the grating (FIG. 5), the concrete can extend above and below the grating, if desired. That is, the grating can be substantially encapsulated with concrete.

While the invention has been described with respect to a grating employing a three-bar system and a locking rod, the invention contemplates grating fabricated using two rails such as the primary load bearing bars and secondary load bearing bars. When the grating is fabricated using two rails, then locking rod 10 is inserted through both rails in a diagonal direction.

It will be seen that gratings in accordance with the present invention overcome the disadvantages of welded gratings referred to earlier. However, even though welds can be applied to the grating of the present invention, welding is believed to be more detrimental than advantageous because welding tends to cause embrittlement and, therefore, provides a site for failure such as fatigue failure. However, the term weldless as used herein can include minor welding, for example, if such were used to hold rod 10 in place, and such is contemplated within the purview of the invention.

Further, while the invention has been depicted showing primary load bearing bars having flanges, the invention contemplates gratings fabricated using plain bars for all three load bearing bars; and in certain gratings, the three bars can have the same dimensions.

The gratings of the invention can be fabricated from metals such as steels, carbon steel, stainless steels and aluminum alloys or from plastics such as fiberglass-reinforced plastics.

In the present invention, if steel bars are used, they may be galvanized prior to assembly or after assembly. If galvanized before assembly, touch up may have to be used to cover scratches resulting from assembly. Further, in the present invention, the slots should be dimensioned to provide for a snug fit to minimize collection of debris such as salts that cause corrosion, particularly in open gratings.

While the invention has been described in terms of preferred embodiments, the claims appended hereto are intended to encompass other embodiments which fall within the spirit of the invention.

What is claimed is:

1. A weldless grating comprising:

(a) a plurality of longitudinally extending primary load-bearing members having an upper portion, a lower portion and a web located between said upper portion and said lower portion, the primary load-bearing member having a plurality of spaced-apart openings in said web, the openings in each of said primary load-bearing members being aligned with the openings in adjacent primary load-bearing members, said opening in said web having:

a generally cross shaped configuration having a generally vertical extent having a top and bottom and a generally horizontal extent having a first side and a second side, the distance between the top and bottom of the vertical extent being shorter than the distance between the first side and the second side of the horizontal extent, the opening having a first land and a second land substantially opposite to each other, the first land extending from the top of said vertical extent to said second side, the second land extending from said first side to said bottom;

(b) a plurality of secondary load-bearing members having an upper edge and a lower edge, the secondary load-bearing members provided with first slots extending downwardly through the upper edge to provide top slots, the secondary load-bearing members positioned in the aligned openings in said web of the primary load-bearing members, said top slot in said secondary load-bearing member forming a locking engagement with said web surrounding said openings in said primary load-bearing members;

(c) a plurality of tertiary load-bearing members having a top edge and a bottom edge, said tertiary load-bearing members provided with tertiary upwardly extending slots in said bottom edge, said tertiary load-bearing members positioned over said secondary load-bearing members, said tertiary upwardly extending slots fitting snugly over said secondary load-bearing members at the point of intersection of said tertiary load-bearing member with said secondary load-bearing members; and (d) a rod extending through said tertiary load-bearing members and said primary load-bearing members locking said tertiary upwardly extending slots of said tertiary load-bearing members on said secondary load-bearing members and locking said secondary load-bearing members in the openings in said primary load-bearing members to form said weldless grating.

2. The grating in accordance with claim 1 wherein each of said the secondary load-bearing members are provided with secondary downwardly extending slots through said upper edge, said secondary downwardly extending slots located between primary load-bearing members, the secondary downwardly extending slots in each of said secondary load-bearing members being aligned with secondary downwardly extending slots in adjacent secondary load-bearing members.

3. The grating in accordance with claim 1 wherein said primary load-bearing members and secondary load-bearing members have a generally rectangular cross section.

4. The grating in accordance with claim 1 wherein said primary load-bearing members are positioned substantially parallel to each other, said secondary load-bearing members are positioned transverse to said primary load-bearing members and said tertiary load-bearing members are positioned substantially parallel to said primary load-bearing members.

5. The grating in accordance with claim 1 wherein said rod extends substantially parallel to said secondary load-bearing members.

6. A weldless grating comprising:

(a) a plurality of substantially parallel longitudinally extending primary load-bearing members having an upper portion, a lower portion and a web located between said upper portion and said lower portion, the primary load-bearing member having a plurality of spaced-apart openings in said web, the openings in each of said primary load-bearing members being aligned with the openings in adjacent primary load-bearing members, said opening in said web defined by: a generally cross shaped configuration having an upwardly extending extent having a top and bottom and a generally horizontal extent having a first side and a second side, the distance between the top and bottom of the upwardly extending extent being shorter than the distance between the first side and the second side of the generally horizontal extent, the opening having a first land and a second land substantially opposite to each other, the first land extending from the top of said upwardly extending extent to said second side, the second land extending from said first side to said bottom;

(b) a plurality of secondary load-bearing members having an upper edge and a lower edge, the secondary load-bearing members provided with first slots extending downwardly through the upper edge to provide top slots and with upwardly extending slots through the lower edge to provide bottom slots located substantially opposite said top slots, the secondary load-bearing members positioned in the aligned openings in said web of the primary load-bearing members, said top and bottom slots in said secondary load-bearing member forming a locking engagement with said web surrounding said openings in said primary load-bearing members, the secondary load-bearing members provided with secondary downwardly extending slots through said upper edge, secondary downwardly extending slots located between primary load-bearing members, the secondary downwardly extending slots in each of said secondary load-bearing members being aligned with secondary downwardly extending slots in adjacent secondary load-bearing members;

(c) a plurality of tertiary load-bearing members positioned in the secondary slots in the secondary load-bearing members, the tertiary load-bearing members having tertiary bottom edges having upwardly extending tertiary bottom slots extending through said tertiary bottom edges to form tertiary bottom slots positioned in alignment with the secondary downwardly extending slots in said secondary load-bearing member to permit said secondary load-bearing members and said tertiary load-bearing members to fixedly engage each other; and (d) a rod extending through said tertiary load-bearing members and said primary load-bearing members locking said tertiary load-bearing members in the slots in said secondary load-bearing members and locking said secondary load-bearing members in the openings in said primary load-bearing members to form said weldless grating.

7. The grating in accordance with claim 6 wherein the primary, secondary, and tertiary members comprise steel members.

8. The grating in accordance with claim 6 wherein the primary, secondary, and tertiary members comprise an aluminum alloy member.

9. The grating in accordance with claim 6 wherein the primary, secondary and tertiary members are substantially rectangular shaped in cross section.

10. The grating in accordance with claim 6 wherein the primary load-bearing members have flanges located below said bottom edges of said secondary load-bearing members, said flanges projecting towards adjacent primary load-bearing members and extending longitudinally along said primary load-bearing member, said flanges located on an opposite wall of an adjacent primary load-bearing members to provide a support for a pan positioned between said primary load-bearing members and resting on said flange to provide a bottom on said grating to contain wet concrete.

11. The grating in accordance With claim 10 wherein said pan is comprised of a longitudinal ridge extending generally parallel to said primary load-bearing members and extending generally upwardly towards the lower edge of said secondary load-bearing members, said pan further comprised of edges adapted to rest on said flanges, said pan shaped to curve upwardly to said ridge to provide sufficient strength in said pan to support wet concrete deposited thereon.

12. The grating in accordance with claim 6 wherein the rod is circular in cross section.

13. The grating in accordance with claim 6 wherein the primary, secondary and tertiary members are assembled to provide a substantially planar surface on said grating.

14. The grating in accordance with claim 6 wherein said secondary load-bearing members are positioned substantially parallel to each other and positioned substantially at right angles across said primary load-bearing members and said tertiary load-bearing members are positioned substantially parallel to said primary load-bearing members.

15. The grating in accordance with claim 6 wherein said rod extends substantially parallel to said secondary load-bearing members.

16. An improved weldless grating comprising:

(a) a plurality of longitudinally extending primary load-bearing members having an upper portion, a lower portion and a web located between said upper portion and said lower portion, the primary load-bearing member having a plurality of spaced-apart openings in said web, the openings in each of said primary load-bearing members being aligned with the openings in adjacent primary load-bearing members;

(b) a plurality of secondary load-bearing members having an upper edge and a lower edge, the secondary load-bearing members provided with first slots extending downwardly through the upper edge to provide top slots, the secondary load-bearing members positioned in the aligned openings in said web of the primary load-bearing members, said top slots in said secondary load-bearing member forming a locking engagement with said web surrounding said openings in said primary load-bearing members;

(c) a plurality of tertiary load-bearing members having a top edge and a bottom edge, said tertiary load-bearing members provided with tertiary upwardly extending slots in said bottom edge, said tertiary load-bearing members positioned over said secondary load-bearing members, said tertiary upwardly extending slots fitting snugly over said secondary load-bearing members at the point of intersection of said tertiary load-bearing member with said secondary load-bearing members; and (d) a rod extending through said tertiary load-bearing members and said primary load-bearing members locking said tertiary load-bearing members in the slots in said secondary load-bearing members and locking said secondary load-bearing members in the openings in said primary load-bearing members to form said weldless grating; the improved weldless grating including said openings in said web of said primary load-bearing member defined by a generally cross shaped configuration having a generally vertical extent having a top and bottom and a generally horizontal extent having a first side and a second side, the distance between the top and bottom of the vertical extent being shorter than the distance between the first side and the second side of the horizontal extent, the opening having a first land and a second land substantially opposite to each other, the first land extending from the top of said vertical extent to said second side, the second land extending from said first side to said bottom.

17. The weldless grating in accordance with claim 16 wherein the distance from said upper edge to said lower edge of said secondary load-bearing member being slightly less than the distance between said first and second sides of said horizontal extent to permit said secondary load-bearing member to slide through said opening in a generally horizontal position.

18. The weldless grating in accordance with claim 17 wherein the distance between said first land and said second land is sufficient to permit said second load-bearing member to be turned to a substantially upright position when said first slots in said upper edge of said second load-bearing member are aligned with said web.

19. The weldless grating in accordance with claim 17 wherein said second land has a raised portion adjacent the bottom of said vertical extent over which the lower edge of said second load-bearing member is passed, said raised portion maintaining said second load-bearing member in an up right position when said second load-bearing member is turned from the horizontal position in said opening of said web of said primary load-bearing members to said upright position.

20. An improved weldless grating comprising:

(a) a plurality of longitudinally extending primary load-bearing members having an upper portion, a lower portion and a web located between said upper portion and said lower portion, the primary load-bearing member having a plurality of spaced-apart openings in said web, the openings in each of said primary load-bearing members being aligned with the openings in adjacent primary load-bearing members;

(b) a plurality of secondary load-bearing members having an upper edge and a lower edge, the secondary load-bearing members provided with first slots extending downwardly through the upper edge to provide top slots and with upwardly extending slots through the lower edge to provide bottom slots located substantially opposite said top slots, the secondary load-bearing members positioned in the aligned openings in said web of the primary load-bearing members, said top and bottom slots in said secondary load-bearing member forming a locking engagement with said web surrounding said openings in said primary load-bearing members, the secondary load-bearing members provided with secondary downwardly extending slots through said upper edge, said secondary downwardly extending slots located between primary load-bearing members;

(c) a plurality of tertiary load-bearing members positioned in the secondary slots in the secondary load-bearing members; and (d) a rod extending through said tertiary load-bearing members and said primary load-bearing members locking said tertiary upwardly extending slot in said tertiary load-bearing members on said secondary load-bearing members and locking said secondary load-bearing members in the openings in said primary load-bearing members to form said weldless grating, the improved weldless grating including said openings in said web of said primary load-bearing member defined by:

a generally cross shaped configuration having a first extent having a top and bottom and a second extent having a first side and a second side, the distance between the top and bottom of the first extent being shorter than the distance between the first side and the second side of the second extent, the opening having a first land and a second land substantially opposite to each other, the first land extending from the top of said first extent to said second side, the second land extending from said first side to said bottom.

21. The weldless grating in accordance with claim 20 wherein the distance from said upper edge to said lower edge of said secondary load-bearing member being slightly less than the distance between said first and second sides of said second extent to permit said secondary load-bearing member to slide through said second extent in a generally horizontal position.

22. The weldless grating in accordance with claim 20 wherein the distance between said first land and said second land is sufficient to permit said second load-bearing member to be turned to a substantially upright position when said first slots in said upper edge of said second load-bearing member are aligned with said web.

23. The weldless grating in accordance with claim 20 wherein said second land has a raised portion adjacent the bottom of said first extent over which the lower edge of said second load-bearing member is passed, said raised portion maintaining said second load-bearing member in an up right position when said second load-bearing member is turned from the horizontal position in said opening of said web of said primary load-bearing members.

24. A concrete module comprising a weldless grating at least partially encapsulated in a body of concrete or overlaid with a body of concrete, the weldless grating comprising:

(a) a plurality of longitudinally extending primary load-bearing members having an upper portion, a lower portion and a web located between said upper portion and said lower portion, the primary load-bearing member having a plurality of spaced-apart openings in said web, the openings in each of said primary load-bearing members being aligned with the openings in adjacent primary load-bearing members, said opening in said web having:

a generally cross shaped configuration having a generally vertical extent having a top and bottom and a generally horizontal extent having a first side and a second side, the distance between the top and bottom of the vertical extent being shorter than the distance between the first side and the second side of the horizontal extent, the opening having a first land and a second land substantially opposite to each other, the first land extending from the top of said vertical extent to said second side, the second land extending from said first side to said bottom;

(b) a plurality of secondary load-bearing members having an upper edge and a lower edge, the secondary load-bearing members provided with first slots extending downwardly through the upper edge to provide top slots, the secondary load-bearing members positioned in the aligned openings in said web of the primary load-bearing members, said top slot in said secondary load-bearing member forming a locking engagement with said web surrounding said openings in said primary load-bearing members;

(c) a plurality of tertiary load-bearing members having a top edge and a bottom edge, said tertiary load-bearing members provided with tertiary upwardly extending slots in said bottom edge, said tertiary load-bearing members positioned over said secondary load-bearing members, said tertiary upwardly extending slots fitting snugly over said secondary load-bearing members at the point of intersection of said tertiary load-bearing member with said secondary load-bearing members; and (d) a rod extending through said tertiary load-bearing members and said primary load-bearing members locking said tertiary upwardly extending slots of said tertiary load-bearing members on said secondary load-bearing members and locking said secondary load-bearing members in the openings in said primary load-bearing members to form said weldless grating.

25. A concrete module comprising a weldless grating at least partially encapsulated in a body of concrete or overlaid with a body of concrete, the weldless grating comprising:

(a) a plurality of substantially parallel longitudinally extending primary load-bearing members having an upper portion, a lower portion and a web located between said upper portion and said lower portion, the primary load-bearing member having a plurality of spaced-apart openings in said web, the openings in each of said primary load-bearing members being aligned with the openings in adjacent primary load-bearing members, said opening in said web having:

a generally cross shaped configuration having a generally vertical extent having a top and bottom and a generally horizontal extent having a first side and a second side, the distance between the top and bottom of the vertical extent being shorter than the distance between the first side and the second side of the horizontal extent, the opening having a first land and a second land substantially opposite to each other, the first land extending from the top of said vertical extent to said second side, the second land extending from said first side to said bottom;

(b) a plurality of secondary load-bearing members having an upper edge and a lower edge, the secondary load-bearing members provided with first slots extending downwardly through the upper edge to provide top slots and with upwardly extending slots through the lower edge to provide bottom slots located substantially opposite said top slots, the secondary load-bearing members positioned in the aligned openings in said web of the primary load-bearing members, said top and bottom slots in said secondary load-bearing member forming a locking engagement with said web surrounding said openings in said primary load-bearing members, the secondary load-bearing members provided with secondary downwardly extending slots through upper top edge, secondary downwardly extending slots located between primary load-bearing members, the secondary downwardly extending slots in each of said secondary load-bearing members being aligned with secondary downwardly extending slots in adjacent secondary load-bearing members;

(c) a plurality of tertiary load-bearing members positioned in the secondary slots in the secondary load-bearing members, the tertiary load-bearing members having tertiary bottom edges having upwardly extending tertiary bottom slots extending through said tertiary bottom edges to form tertiary bottom slots positioned in alignment with the secondary downwardly extending slots in said secondary load-bearing member to permit said secondary load-bearing members and said tertiary load-bearing members to fixedly engage each other; and (d) a rod extending through said tertiary load-bearing members and said primary load-bearing members locking said tertiary load-bearing members in the slots in said secondary load-bearing members and locking said secondary load-bearing members in the openings in said primary load-bearing members to form said weldless grating.

26. A concrete module comprising an improved weldless grating at least partially encapsulated in a body of concrete, the weldless grating comprising:

(a) a plurality of longitudinally extending primary load-bearing members having an upper portion, a lower portion and a web located between said upper portion and said lower portion, the primary load-bearing member having a plurality of spaced-apart openings in said web, the openings in each of said primary load-bearing members being aligned with the openings in adjacent primary load-bearing members;

(b) a plurality of secondary load-bearing members having an upper edge and a lower edge, the secondary load-bearing members provided with first slots extending downwardly through the upper edge to provide top slots, the secondary load-bearing members positioned in the aligned openings in said web of the primary load-bearing members, said top slots in said secondary load-bearing member forming a locking engagement with said web surrounding said openings in said primary load-bearing members;

(c) a plurality of tertiary load-bearing members having a top edge and a bottom edge, said tertiary load-bearing members provided with tertiary upwardly extending slots in said bottom edge, said tertiary load-bearing members positioned over said secondary load-bearing members, said tertiary upwardly extending slots fitting snugly over said secondary load-bearing members at the point of intersection of said tertiary load-bearing member with said secondary load-bearing members; and (d) a rod extending through said tertiary load-bearing members and said primary load-bearing members locking said tertiary load-bearing members in the slots in said secondary load-bearing members and locking said secondary load-bearing members in the openings in said primary load-bearing members to form said weldless grating;

the improved grating including said openings in said web of said primary load-bearing member defined by:

a generally cross shaped configuration having a generally vertical extent having a top and bottom and a generally horizontal extent having a first side and a second side, the distance between the top and bottom of the vertical extent being shorter than the distance between the first side and the second side of the horizontal extent, the opening having a first land and a second land substantially opposite to each other, the first land extending from the top of said vertical extent to said second side, the second land extending from said first side to said bottom.

27. An improved concrete module comprising a weldless grating at least partially encapsulated in a body of concrete, the weldless grating comprising:

(a) a plurality of longitudinally extending primary load-bearing members having an upper portion, a lower portion and a web located between said upper portion and said lower portion, the primary load-bearing member having a plurality of spaced-apart openings in said web, the openings in each of said primary load-bearing members being aligned with the openings in adjacent primary load-bearing members;

(b) a plurality of secondary load-bearing members having an upper edge and a lower edge, the secondary load-bearing members provided with first slots extending downwardly through the upper edge to provide top slots and with upwardly extending slots through the lower edge to provide bottom slots located substantially opposite said top slots, the secondary load-bearing members positioned in the aligned openings in said web of the primary load-bearing members, said top and bottom slots in said secondary load-bearing member forming a locking engagement with said web surrounding said openings in said primary load-bearing members, the secondary load-bearing members provided with secondary downwardly extending slots through said upper edge, said secondary downwardly extending slots located between primary load-bearing members;

(c) a plurality of tertiary load-bearing members positioned in the secondary slots in the secondary load-bearing members; and (d) a rod extending through said tertiary load-bearing members and said primary load-bearing members locking said tertiary upwardly extending slot in said tertiary load-bearing members on said secondary load-bearing members and locking said secondary load-bearing members in the openings in said primary load-bearing members to form said weldless grating, the grating including said openings in said web of said primary load-bearing member defined by:

a generally cross shaped configuration having a generally vertical extent having a top and bottom and a generally horizontal extent having a first side and a second side, the distance between the top and bottom of the vertical extent being shorter than the distance between the first side and the second side of the horizontal extent, the opening having a first land and a second land substantially opposite to each other, the first land extending from the top of said vertical extent to said second side, the second land extending from said first side to said bottom to provide said improved concrete module.

28. In an improved weldless grating comprised of a plurality of longitudinally extending primary load-bearing members having an upper portion, a lower portion and a web located between said upper portion and said lower portion, the primary load-bearing member having a plurality of spaced-apart openings in said web, the openings in each of said primary load-bearing members being aligned with the openings in adjacent primary load-bearing members, the improvement wherein said openings in said web are defined by:

(a) a generally cross shaped configuration having a generally vertical extent having a top and bottom and a generally horizontal extent having a first side and a second side, the distance between the top and bottom of the vertical extent being shorter than the distance between the first side and the second side of the horizontal extent, the opening having a first land and a second land substantially opposite each other, the first land extending from the top of said vertical extent to said second side, the second land extending from said first side to said bottom; and (b) a plurality of secondary load-bearing members having an upper edge and a lower edge, the secondary load-bearing members provided with first slots extending downwardly through the upper edge to provide top slots, the secondary load-bearing members positioned in the aligned openings in said web of the primary load-bearing members, said top slot in said secondary load-bearing member forming a locking engagement with said web surrounding said openings in said primary load-bearing members.

29. In an improved weldless grating comprised of a plurality of substantially parallel longitudinally extending primary load-bearing members having an upper portion, a lower portion and a web located between said upper portion and said lower portion, the primary load-bearing member having a plurality of spaced-apart openings in said web, the openings in each of said primary load-bearing members being aligned with the openings in adjacent primary load-bearing members, the improvement wherein said opening in said web is defined by:

a generally cross shaped configuration having a generally vertical extent having a top and bottom and a generally horizontal extent having a first side and a second side, the distance between the top and bottom of the vertical extent being shorter than the distance-between the first side and the second side of the horizontal extent, the opening having a first land and a second land substantially opposite to each other, the first land extending from the top of said vertical extent to said second side, the second land extending from said first side to said bottom, said lands providing a bearing surface for a secondary load-bearing member;

a plurality of secondary load-bearing members having an upper edge and a lower edge, the secondary load-bearing members provided with first slots extending downwardly through the upper edge to provide top slots and with upwardly extending slots through the lower edge to provide bottom slots located substantially opposite said top slots, the secondary load-bearing members positioned in the aligned openings in said web of the primary load-bearing members, said top and bottom slots in said secondary load-bearing member forming a locking engagement with said web surrounding said openings in said primary load-bearing members, the secondary load-bearing members provided with secondary downwardly extending slots through said upper edge, secondary downwardly extending slots located between primary load-bearing members, the secondary downwardly extending slots in each of said secondary load-bearing members being aligned with secondary downwardly extending slots in adjacent secondary load-bearing members.

* * * * *